US005515546A

United States Patent [19]

Shifrin

[11] Patent Number: 5,515,546

[45] Date of Patent: May 14, 1996

[54] FOLDABLE PADDED HELMET

[76] Inventor: Roy Shifrin, P.O. Box 5096, Hanover, N.H. 03755

[21] Appl. No.: 305,891

[22] Filed: Sep. 14, 1994

[51] Int. Cl.[6] ..... A42B 3/00

[52] U.S. Cl. ..... 2/410; 2/418; 2/425; 2/209.11; 224/577

[58] Field of Search ..... 2/205, 202, 209.11, 2/209.12, 209.3, 410, 411, 412, 414, 417, 418, 421, 425, 420; 190/1; 224/151, 153, 202, 257, 258; 383/4

[56] References Cited

U.S. PATENT DOCUMENTS

| | | | |
|---|---|---|---|
| 3,087,166 | 4/1963 | Howard | 2/420 |
| 3,171,133 | 3/1965 | Steffen | 2/414 |
| 3,197,784 | 8/1965 | Carlisle | 2/420 |
| 4,856,119 | 8/1989 | Haberle | 2/417 |
| 5,012,533 | 5/1991 | Raffler | 2/425 X |
| 5,173,970 | 12/1992 | Shifrin | 2/425 X |
| 5,271,103 | 12/1993 | Darnell | 2/418 |

FOREIGN PATENT DOCUMENTS

| | | | |
|---|---|---|---|
| 280042 | 8/1988 | European Pat. Off. | 2/411 |
| 3632525 | 3/1988 | Germany | 2/410 |

*Primary Examiner*—Michael A. Neas

*Attorney, Agent, or Firm*—Sughrue, Mion, Zinn, Macpeak & Seas

[57] ABSTRACT

A combined protective helmet and pouch for a bicyclist or the like is constructed from a plurality of sector shaped pads of shock absorbing material connected together in an inextensible manner to define a helmet. The connectors between the pads at the side of the helmet may be folded to bring the front and rear halves of the helmet together to define a pouch. Adjustable members are provided to adjust the spacing between the pads and a suitable chin strap and carrying strap are connected to the helmet.

4 Claims, 2 Drawing Sheets

FIG. 1
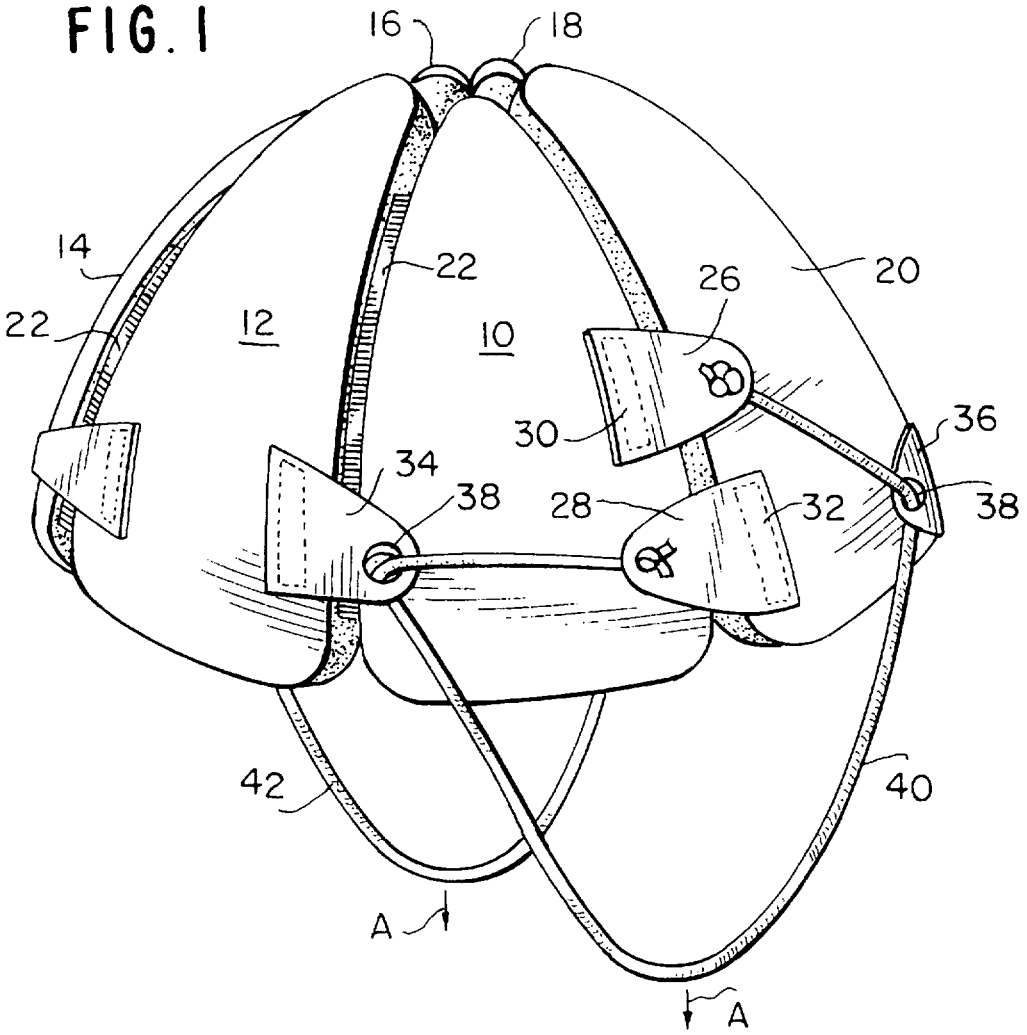
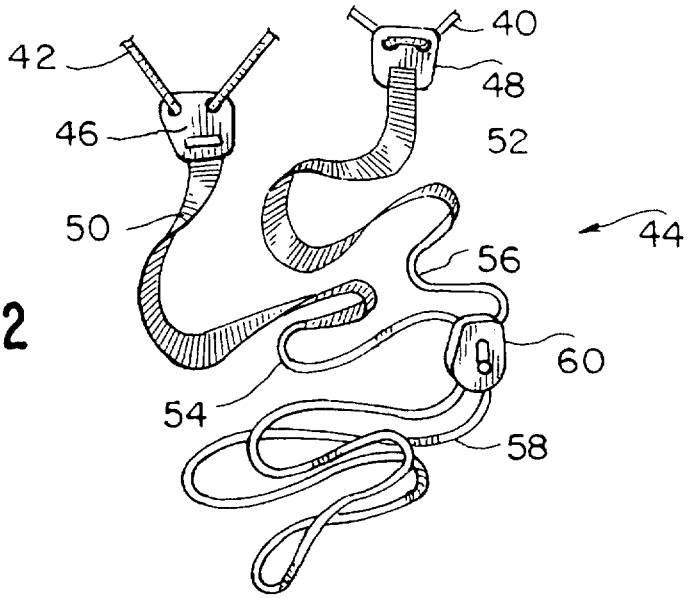
FIG. 2

FIG. 3
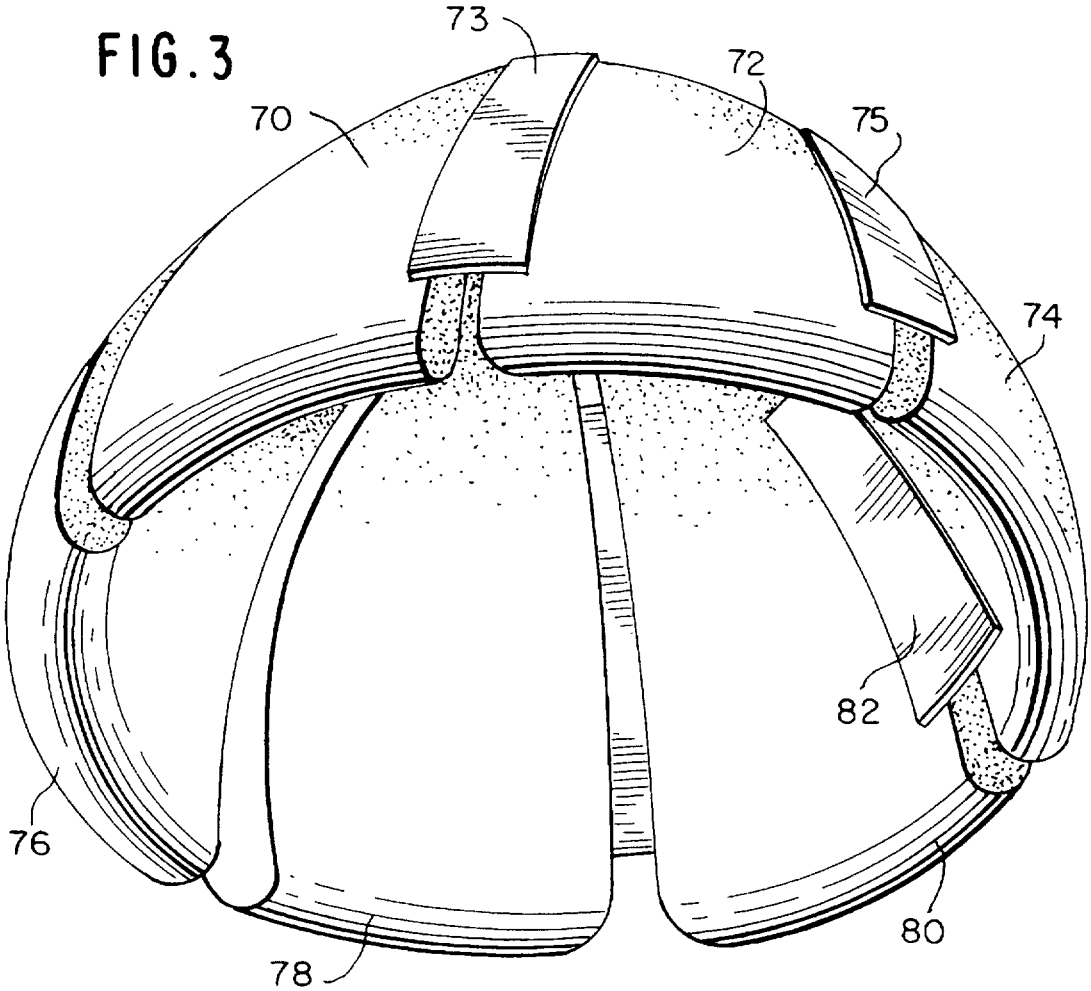
FIG. 4A
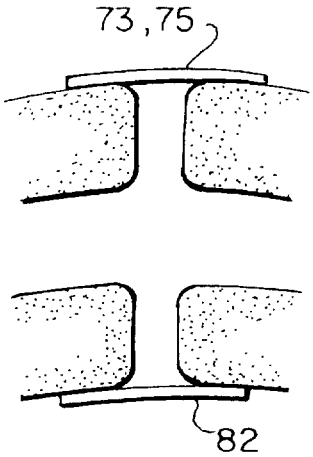
FIG. 4B
FIG. 5A
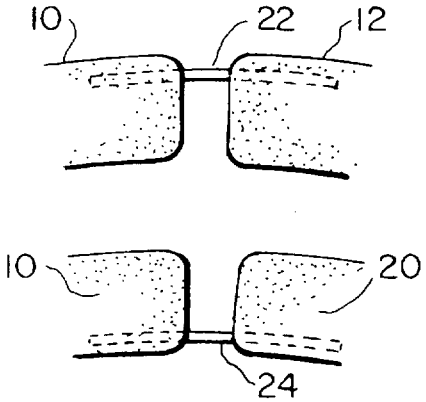
FIG. 5B

FOLDABLE PADDED HELMET

BACKGROUND OF THE INVENTION

The present invention is directed to a helmet made of foam and plastic segments interconnected by flexible fabric strips, and more particularly to a comfortable, attractive cap-type protective helmet particularly useful for bicyclists and which may be folded to function as a pouch for holding small objects and which may be attached about the waist or slung over the shoulder when not worn on the head of the bicyclist.

Protective helmets and other head gear have evolved over the years to protect the wearer while participating in various sports, such as bicycling, skating and the like. Most of these protective helmets are rigid helmets which are uncomfortable to wear, result in excessive perspiration about the head and are normally produced of non-absorbent material. Furthermore, such helmets, when removed from the head, are awkward to handle and are of an uncomfortable shape, making them difficult to carry about.

U.S. Pat. No. 5,173,970 in the name of the present Applicant and entitled "Combined Visored Cap-type Protective Helmet and Pouch for Bicyclists or the Like" provides a flexible, lightweight, foldable protective helmet for a bicyclist or the like. The helmet is comprised of a hollow, spherical fabric head shell including an outer fabric body and an integrated inner lining. Circumferentially spaced, generally radial fold lines emanate from the center of the head shell and join the outer fabric body to the inner lining and form circumferentially adjacent separate pockets. Soft protective pads are sized and shaped to the pockets and carried therein. Protective material may be hard styrofoam lined with a softer material. A visor is integrated to the head shell at a circular bottom edge thereof at the front of the helmet and projects outwardly of the helmet and extends rearwardly along opposite sides thereof. Aligned fold lines extending over both sides of the helmet facilitate folding of the helmet about the aligned transverse fold lines. The foldable front and rear halves of the head shell halves define an article carrying pouch therebetween. Latching means are provided for latching the front and rear halves together to maintain the folded visor internally of the pouch cavity as well as the articles placed therein. A pair of chin straps may be attached to the head shell at opposite sides and are detachably coupled to each other to maintain the helmet on the bicyclist. Additionally, the protective helmet may be provided with a belt and shoulder strap system of adjustable length for permitting the combined helmet and pouch to be employed in a pouch mode and suspended from the shoulder of the bicyclist or strapped about the waist of the bicyclist.

SUMMARY OF THE INVENTION

The present invention provides a new and improved foldable padded helmet wherein a plurality of substantially triangular curved pad segments or sector-shaped pad segments are interconnected by flexible strips to define a helmet structure adapted to fit on the head of a wearer and which may be folded to provide an article carrying pouch. Suitable chin straps and carrying straps are provided to facilitate the use of the helmet in both modes.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 1 is a front and right side perspective view of a preferred embodiment according to the present invention and including a cord system for adjusting the helmet size.

FIG. 2 is a combined chin strap and carrying strap adapted to be connected to the cord system of FIG. 1.

FIG. 3 is a perspective view of the front, left side and interior of a modified helmet construction according to the present invention.

FIG. 4A is a partial end view of two adjacent pads showing the arrangement of the connecting strip at front and rear locations on the helmet.

FIG. 4B is a view similar to FIG. 4A showing the arrangement of a connecting strip at opposite sides of the helmet to facilitate the folding of the helmet into a substantially flat pouch.

FIG. 5A is an end view of two adjacent pads in the embodiment of FIG. 1 showing the connecting strip integrally molded with the pads for use with front and rear joints between adjacent pads.

FIG. 5B is a view similar to FIG. 5A showing the location of the integrally molded strip for the two opposite side joints of the helmet to facilitate folding of the helmet.

DETAILED DESCRIPTION OF THE INVENTION

In the preferred embodiment of the invention as shown in FIG. 1, a plurality of identical pads 10, 12, 14, 16, 18 and 20 are interconnected by means of flexible strips, only 2 of which are shown in FIG. 1. The pads may be molded of expanded polystyrene (EPS) or any other suitable padding material and the connecting strips 22 may be integrally molded into the fabric pads as shown in FIG. 5A.

The pads 10, 12 and 14 would constitute the front of the helmet, whereas the pads 16, 18 and 20 would constitute the rear of the helmet. The connecting strips 22 would be integrally molded in the manner shown in FIG. 5A between the pads 10 and 12, between the pads 12 and 14, between the pads 16 and 18 and between the pads 18 and 20. At the sides of the helmet, the connecting strips 24 are integrally molded between the pads 10 and 20 and between the pads 14 and 16 as shown in FIG. 5B. Thus the connecting strips 22 are located closer to the outer surface of the helmet whereas the connecting strips 24 are located closer to the inner surface of the helmet to facilitate the folding of the front and rear halves of the helmet to define a substantially flattened pouch.

As seen in FIG. 1, the pads have a substantially triangular curved configuration to define the shape of the helmet with an opening at the top of the helmet to provide ventilation. While the pads are preferably made of EPS, the pads could be constructed of any other suitable padding material which could be molded so as to facilitate the integral molding of the connecting strips. It is conceivable that the connecting strips could also be of the plastic material with the mold designed so as to simultaneously form thin connecting portions of the plastic material integral with the thicker pad portions.

The maximum size of the helmet is determined by the dimensions of the pads as well as the width of the connecting strips therebetween. In order to provide a helmet wherein one size fits all and since the connecting strips are inextensible, the size of the helmet may be reduced by means of the cord system shown in FIG. 1. The cord system is identical on each side of the helmet and accordingly, only the cord system for the right side of the helmet, as shown in FIG. 1, will be described in detail. The tabs 26 and 28 are secured to the pads 10 and 20, respectively, by any suitable means such as adhesive strips 30 and 32 respectively. It would also be possible to stitch the tabs onto the pads or secure them by any other suitable means. A pair of identical tads 34 and 36 are secured to the pads 12 and 18 in the same manner in which the tabs 26 and 28 are secured to the pads. The tabs 26 and 28 overlie the connecting strip 24 between the pads 10 and 20 and extend in opposite directions to each other. The tab 34 which is connected to the pad 12 overlies the connecting strip 22 between the pads 10 and 12 and the tab 36, which is connected to the pad 18, overlies the connecting strip 22 between the pads 18 and 20. Each of the tabs has a substantially triangular configuration with an aperture 38 adjacent the apex of the triangle. A cord 40 extends through the aperture 38 in the tab 26 and is knotted at the end thereof or otherwise attached to the tab 26. The cord then extends through the aperture in the tab 36, the aperture in the tab 34 and the aperture in the tab 28 in that sequence with the opposite end of the cord 40 being knotted after passing through the aperture in the tab 28 or otherwise secured to the tab 28. Thus, upon exertion of a downward force on the cord 40 in the direction of the arrow A, the pads 10, 12, 18 and 20 will all be drawn together, thereby reducing the size of the helmet. An identical cord system is provided between the pads 12, 14, 16 and 18 on the opposite side of the helmet and upon exertion of a downward force on the cord 42 in the direction of the arrow A, the size of the helmet will be reduced.

A combination chin strap and carrying cord 44 is shown in FIG. 2. The cords 40 and 42 extend through holes in connecting plates 46 and 48 of any suitable construction. A pair of chin straps 50 and 52, which may be of inextensible fabric, are each connected at one end to a connecting plate 46 and 48, respectively. The opposite ends of the chin straps 50 and 52 are connected at 54 and 56 to opposite ends of a cord 58 by any suitable means such as stitching or the like. The cord extends through a conventional slide locking device whereby opposite ends of the cord 58 may be a slidably mounted movement through the slide locking device 60 or may be locked in a fixed position relative to the slide lock member 60. Thus, when the helmet is worn on the head, the chin straps 50 and 52 would extend downwardly from the cords 42 and 40, respectively, under the chin of the wearer. The slide locking device 60 may then be moved upwardly to tighten the chin straps underneath the chin of the wearer. When the helmet is not being worn, the helmet may be folded about the connecting strips 24 and opposite sides of the helmet to define a relatively flat carrying pouch. The slide locking device 60 may be moved away from the chin straps 50 and 52 so as to elongate the loop between the cords 40 and 42 thereby enabling the cord 58 to extend about the waist of the wearer or extend over the shoulder of the wearer. The functional length of the loop can be adjusted by the slide locking device 60 in a manner well known in the art. A modified helmet construction is shown in FIG. 3 wherein the pads 70, 72 and 74, which constitute the front of the helmet, are interconnected by means of connecting strips 73 and 75 which are secured to the outer surface of the pads by any suitable means, such as an adhesive or stitching. The strips 73 and 75 may be made of any suitable inextensible fabric such as nylon or the like or may be made of an inextensible plastic material which could be bonded to the outer surface of the EPS pads by any suitable means.

The pads 76, 78 and 80, which constitute the rear portion of the helmet, are also interconnected to each other by means of connecting strips similar to the strips 73 and 75 in the same manner. The pads 74 and 80 are interconnected by means of a connecting strip 82 as shown in FIG. 3 on the inside of the helmet. A similar connecting strip is secured on the inside of the pads 70 and 76 to interconnect those pads. Thus the connecting strips on the inside of the helmet at the opposite sides thereof enable the front and rear portions of the helmet to be folded towards each other to form a substantially flattened pouch. The arrangement of the outer connecting strips 73 and 75, as shown in FIG. 4A and the arrangement of the inner connecting strips 82 between the pads is shown in FIG. 4B.

The helmet as shown in FIG. 3 may be provided with a cord system identical to that in FIG. 1. Likewise, the helmet of FIG. 3 may be provided with chin straps and a carrying cord similar to those shown in FIG. 2.

In lieu of the connecting strips between the pads, a lacing system could be provided to interconnect the pads in an adjustable manner.

While the invention has been particularly shown and described with reference to preferred embodiments thereof, it will be understood by those in the art that the foregoing and other changes in form and details may be made therein without departing from the spirit and scope of the invention.

What is claimed is:

1. A combined protective helmet and pouch comprising a plurality of sector shaped protective pads of shock absorbing material disposed in spaced apart adjacent relationship, a plurality of strip-like connectors connected to and extending between each pair of adjacent pads in a circumferential direction to interconnect said pads to each other in a helmet-shaped configuration and adjustable means connected to said pads for adjusting the spacing between said pads, wherein said connecting strips disposed at opposite sides of said helmet are integrally molded in adjacent pads approximate to an inner surface of said pads with remaining connecting strips integrally molded between adjacent pads approximate an outer surface of said pads.

2. A combined protective helmet and pouch comprising a plurality of sector shaped protective pads of shock absorbing material disposed in spaced apart adjacent relationship, a plurality of strip-like connectors connected to and extending between each pair of adjacent pads in a circumferential direction to interconnect said pads to each other in a helmet-shaped configuration and adjustable means connected to said pads for adjusting the spacing between said pads, wherein said connecting strips disposed at opposite sides of said helmet are connected between adjacent pads on an inner surface of said pads with remaining connecting strips connected between said pads on an outer surface of said pads.

3. A combined protective helmet and pouch comprising a plurality of sector shaped protective pads of shock absorbing material disposed in spaced apart adjacent relationship, a plurality of strip-like connectors connected to and extending between each pair of adjacent pads in a circumferential direction to interconnect said pads to each other in a helmet-shaped configuration and adjustable means connected to said pads for adjusting the spacing between said pads, said adjustable means comprising a cord system mounted on exterior surfaces of said pads at opposite sides of said helmet, each cord system comprising a plurality of tabs secured to outer surfaces of said pads and having free end portions overlying connecting strips between said pads and having apertures therein and an adjusting cord extending through said apertures to adjust the size of said helmet.

4. A protective helmet as set forth in claim 3, further comprising a combination chin strap and carrying cord connected at opposite sides to said cords and having slide means mounted thereon for adjusting an effective length of the combination chin strap and carrying cord.

* * * * *